US005829299A

United States Patent [19]

Wessels

[11] Patent Number: 5,829,299

[45] Date of Patent: Nov. 3, 1998

[54] METHOD AND APPARATUS FOR MAKING NIPPLE HOLES IN A DOUBLE-WALLED HOLLOW WHEEL RIM OF A SPOKE WHEEL

[75] Inventor: Jasper Johannes Wessels, Edam, Netherlands

[73] Assignee: Holland Mechanics B.V., PZ Purmerend, Netherlands

[21] Appl. No.: 809,956

[22] PCT Filed: Oct. 5, 1995

[86] PCT No.: PCT/NL95/00337

§ 371 Date: Apr. 3, 1997

§ 102(e) Date: Apr. 3, 1997

[87] PCT Pub. No.: WO96/11075

PCT Pub. Date: Apr. 18, 1996

[30] Foreign Application Priority Data

Oct. 5, 1994 [NL] Netherlands ..... 9401639

[51] Int. Cl.[6] ..... B21D 28/30

[52] U.S. Cl. ..... 72/327; 72/335; 73/54; 73/684; 29/894.35

[58] Field of Search ..... 72/325, 327, 333, 72/335; 83/54, 694, 684; 29/894.35, 894.353; 301/95

[56] References Cited

U.S. PATENT DOCUMENTS

| | | | |
|---|---|---|---|
| 1,697,817 | 1/1929 | Kuhn | 72/327 |
| 1,762,542 | 6/1930 | Booth | 29/894.35 |
| 2,848,805 | 8/1958 | Brink | 72/335 |
| 3,971,275 | 7/1976 | Mach | 83/54 |
| 4,545,440 | 10/1985 | Treadway | 72/325 |
| 4,819,472 | 4/1989 | Daudi | 72/327 |

FOREIGN PATENT DOCUMENTS

| | | | |
|---|---|---|---|
| A369367 | 5/1930 | Belgium . | |
| 579525 | 1/1994 | European Pat. Off. | 29/894.35 |
| A16 60 033 | 12/1970 | Germany . | |
| A28 33 329 | 2/1980 | Germany . | |

*Primary Examiner*—Daniel C. Crane
*Attorney, Agent, or Firm*—Panitch Schwarze Jacobs & Nadel, P.C.

[57] ABSTRACT

The invention relates to a method of making nipple holes or similar holes in a double-walled wheel rim having an inner wall positioned radially inward and outside of that an outer wall. The holes are made by punching by means of a punching tool provided with a cutting edge whereby the cutting edge is moved successively through the outer wall and the inner wall of the wheel rim and a punch die supporting the inner wall. The invention encompasses also an apparatus for the application of this method.

16 Claims, 4 Drawing Sheets

(a)

METHOD AND APPARATUS FOR MAKING NIPPLE HOLES IN A DOUBLE-WALLED HOLLOW WHEEL RIM OF A SPOKE WHEEL

This application is a 371 of PCT/NL95/00337, filed Oct. 5, 1995.

The invention relates to a method for making aligned holes in both walls of a double-walled hollow wheel rim.

Such a method is known from EP-A-0 579 525. According to this publication (see FIG. 8), the holes are drilled from one direction through both walls of the double-walled hollow wheel rim. This drilling is an expensive and time consuming method, whereby chips and drilling oil will enter into the hollow space inside the wheel rim, which contamination will have to be washed out.

The costs of drilling and cleaning and the involved production time have hindered the more general use of double-walled hollow wheel rims in bicycles, which rims are now mainly used in more expensive bicycles for instance for racing.

It is a first object of the invention to provide a method for making holes in a double-walled hollow wheel rim in an efficient manner, and to obviate the drawbacks associated with the prior art.

To this end, in the method according to the invention the wheel rim is positioned against a punch die, and a punching tool with a cutting edge is moved in a continuous movement through both walls of the wheel rim and the punch die.

By punching the holes in both walls in a continuous movement of the same tool, both holes are in perfect alignment, while the process is quick and gives no contamination of oil and chips inside the hollow wheel rim.

In a preferred embodiment of the method according to the invention, the diameter of the first made hole is enlarged by passing during the same continuous movement an expansion tool, being part of the punching tool, through the hole, whereby the punching tool is stopped before the expansion tool reaches the wall supported by the punch die.

In this way the holes are made with differing diameters in an efficient manner.

In accordance with another aspect of the invented method, the punching tool is accelerated to a speed of at least 10 m/sec before the cutting edge is moved through the first wall of the wheel rim.

By making use of this high speed it is avoided that near the hole the unsupported first wall bends inwards.

The invention also relates to an apparatus suitable for operating the method of the invention for punching holes in a wheel rim, comprising a rim support with a punching die, a punching tool with a cutting edge which is movable from a start position at a distance from the punching die to a stop position whereby the cutting edge is inside the punching die and drive means for the punching tool.

The apparatus according to the invention is characterized in that in use the drive means can extend such a force on the punching tool that it accelerates from the start position to a speed of at least 10 m/sec before the cutting edge touches a first wall of a double-walled hollow wheel rim which is with its second wall positioned against the punch die.

It is remarked that an apparatus for punching holes in a wheel rim is known per se from U.S. Pat. No. 4,854,201. However, the known apparatus is not suitable for punching holes in an unsupported wall, as is required when punching holes in a double-walled hollow wheel rim.

In the apparatus according to the invention the punching tool will make a hole in the first wall without bending this wall, so that the shape of the wheel rim is maintained.

It is desirable that the apparatus of the invention includes braking means to allow the punching tool to be arrested over a short distance.

This makes it possible to reduce the dimensions of the punching tool.

The invention also relates to a double-wailed hollow wheel rim manufactured according to the invention and provided with aligned holes in each wall whereby the hole with the largest diameter is in the outer wall.

In the wheel rim in accordance with the invention the material around the hole in the outer wall is bent inwards on a curved radius.

This way an air-filled tube resting onto the outer wall of the wheel rim cannot be damaged by the sharp edge of the hole and additional costs for making and placing additional parts to prevent such damage are circumvented.

The invention will be elucidated by means of the drawings in which an embodiment of the invention is schematically illustrated.

FIGS. 1–5 show different steps of the method according to the invention in a schematic cross-section of a wheel rim, and a punching tool, however, for sake of clarity without showing the punch die supporting the inner wall of the wheel rim.

FIGS. 6*a* and *b* are perspective views on a larger scale of two embodiments of the punching tool applied in FIGS. 1–5.

Figures 1, 2, 3, 4, 5:
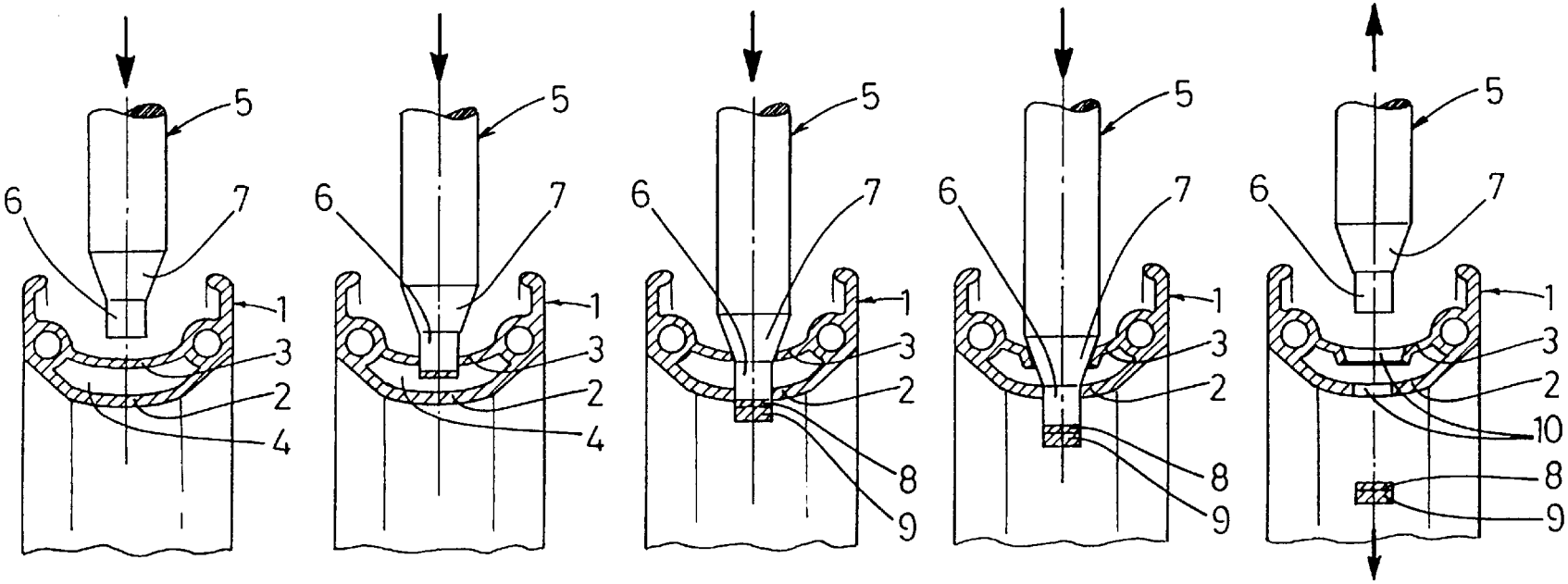

FIGS. 1–5 show the cross-sectional profile of a double-walled wheel rim 1 having an inner wall 2, an outer wall 3 and a hollow space 4 between the two walls 2 and 3. This wheel rim 1 has to be provided with holes for fitting spokes and spoke nipples (not shown). These holes may be made so that they are positioned radially or under a slight angle in relation to the radial. Apart from the nipple holes a somewhat larger hole must also be made for the valve. The inner wall 2 is generally thicker than the outer wall 3, for instance 2.5–2.8 mm as opposed to 1.0–1.1 mm and for this reason one will allow the head of the spoke nipple to rest on the inner wall 2.

According to the invention the holes in the wheel rim 1 are made by punching, using a punching tool 5. This punching tool 5 possesses a cylindrical front part 6 and an adjacent tapered conical part 7 having a nose angle of, for instance 40°. The point of the front part 6 of the punching tool 5 will be described later.

The punching tool 5 achieves a velocity of at least 10 m/sec, possibly increasing to 50 m/sec and preferably 30 m/sec. Due to this high velocity a platelet of material is punched out of the walls 2 and 3 of the wheel rim 1 with such high velocity that the material does not get the chance to deform. With lower punching velocities, for instance 8–15 m/sec, the punching tool makes a dent in the unsupported outer wall 3 causing the inner walls of the wheel rim to bend inward (especially with narrow wheel rims), while also tearing occurs. When the punching velocity is increased these detrimental effects surprisingly disappear. In the embodiment according to FIGS. 1–5, punching occurs from the outside of the wheel rim 1 toward the center (axis) of the wheel rim, so that first a small disc 8 is punched out of the outer wall 3 (FIG. 2), and subsequently, with the small disc 8 still attached to the point of the punching tool 5, a small disc 9 is punched out of the inner wall 2 (FIG. 3). Then, the punching tool's 5 conical part 7 somewhat conically expands or bends outwards the hole 10 in the outside wall 3 of the wheel rim 1 to allow simple assembly by passing through the head of a spoke nipple, not shown. When the desired punching depth is reached (when the conical part 7 has not yet reached the inner wall 2) the punching tool 5 is arrested very quickly and then retracted to make the following hole.

Figure 6A:
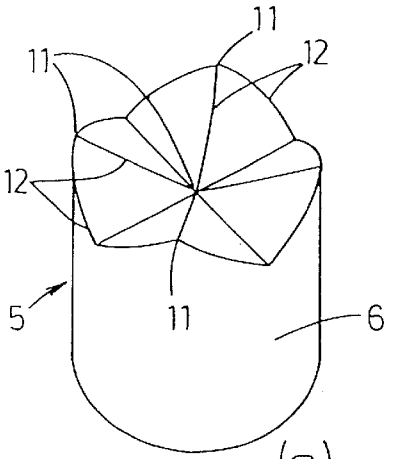
Figure 6B:
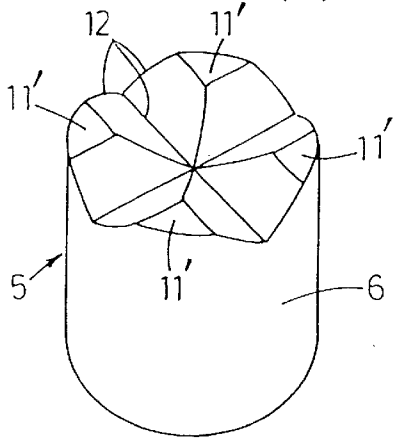

FIGS. 6*a* and 6*b* show embodiments of the point of a punching tool 5. The point is provided with four cutting teeth 11, evenly distributed over the circumference, being connected with each other from the circumference and crosswise by concave cutting edges 12. The difference in hight from the cutting teeth 11 on the circumference to the middle of the point is preferably greater than the thickness of the outer wall 3 of the wheel rim 1 to be punched first. This type of point has been shown to be very advantageous for punching because the disc 8 cut out from the hole 10 in the outer wall 3 is retained in the cavities between the cutting teeth 11 and does not protrude outwards, so that the punching of the following hole is not obstructed by the disc. The embodiment according to FIG. 6*b* shows instead of the cutting teeth 11 a small flat surface 11'.

Figure 7:
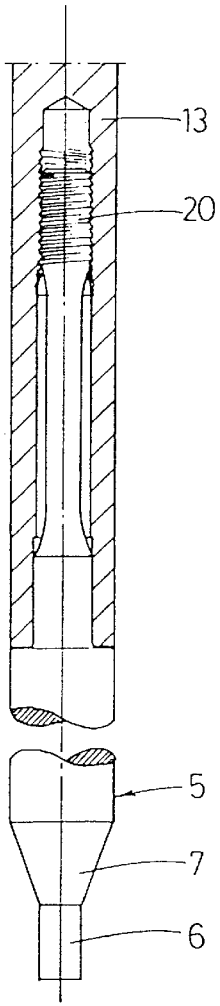
FIG. 7 shows from the side, and partly in cross-section, the assembly of a punch tool in the punch apparatus.

FIG. 7 shows the detachability of the punching tool 5 in a piston rod 13 of the apparatus. This detachability in the shape of a thread 20 is especially designed bearing in mind the great forces that are brought to bear on this connection.

Figure 8:
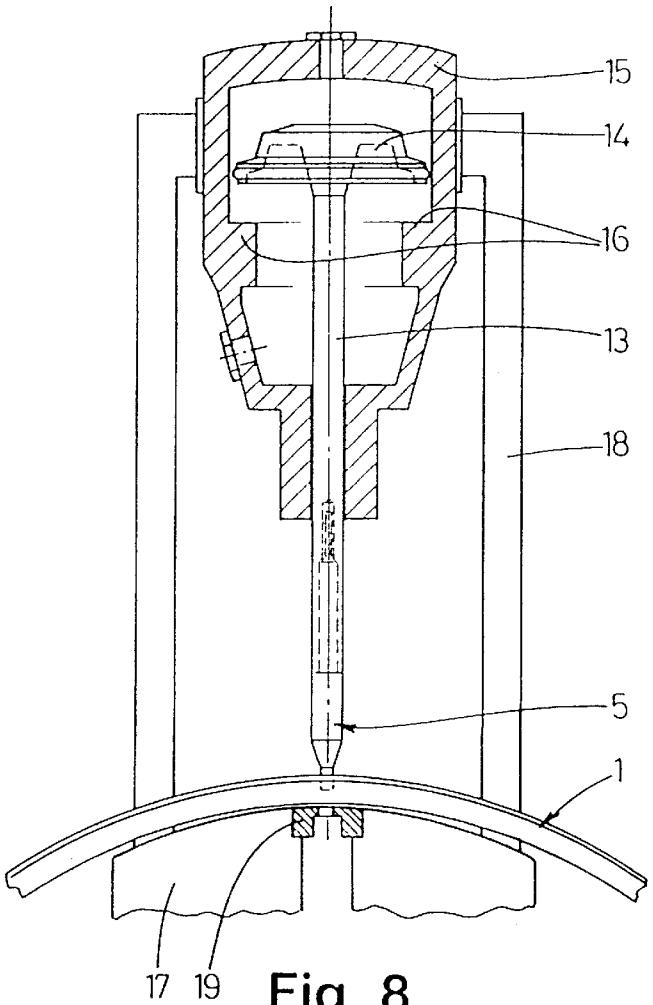
FIG. 8 is a very schematic cross-section of an apparatus for punching the holes into the double-walled wheel rims.

FIG. 8 shows very schematically the principle of the apparatus for punching the holes. This apparatus comprises a piston rod 13 connected with the piston 14 which can be pneumatically driven and also arrested, in a manner which is not further described. This kind of operating principle is for instance also applied in portable nail apparatuses. The piston 14 is housed in a house 15 and this house 15 is provided with a stop for the final arrest of the piston 14 at the end of the punching stroke. This stop may be mechanical, whereby for instance the rim 16, as illustrated, optionally has plastic buffer and/or may be provided with a pneumatic buffer. The stop 16 or the entire house 15 may be adjustable in height in relation to a rim clamp 17 which is connected to the house 15 with the aid of a connective organ 18. The setting of the stop 16 in relation to the punch die 19 is, among others, determined by the distance from the beginning of the punching tool's 5 conical part 7 to the part of the piston 14 intermating with the stop 16. In FIG. 8 a punch die 19 can also be seen which intermates with the punching tool 5 and supports the wheel rim all around the hole 10 which is to be made.

Figure 9:
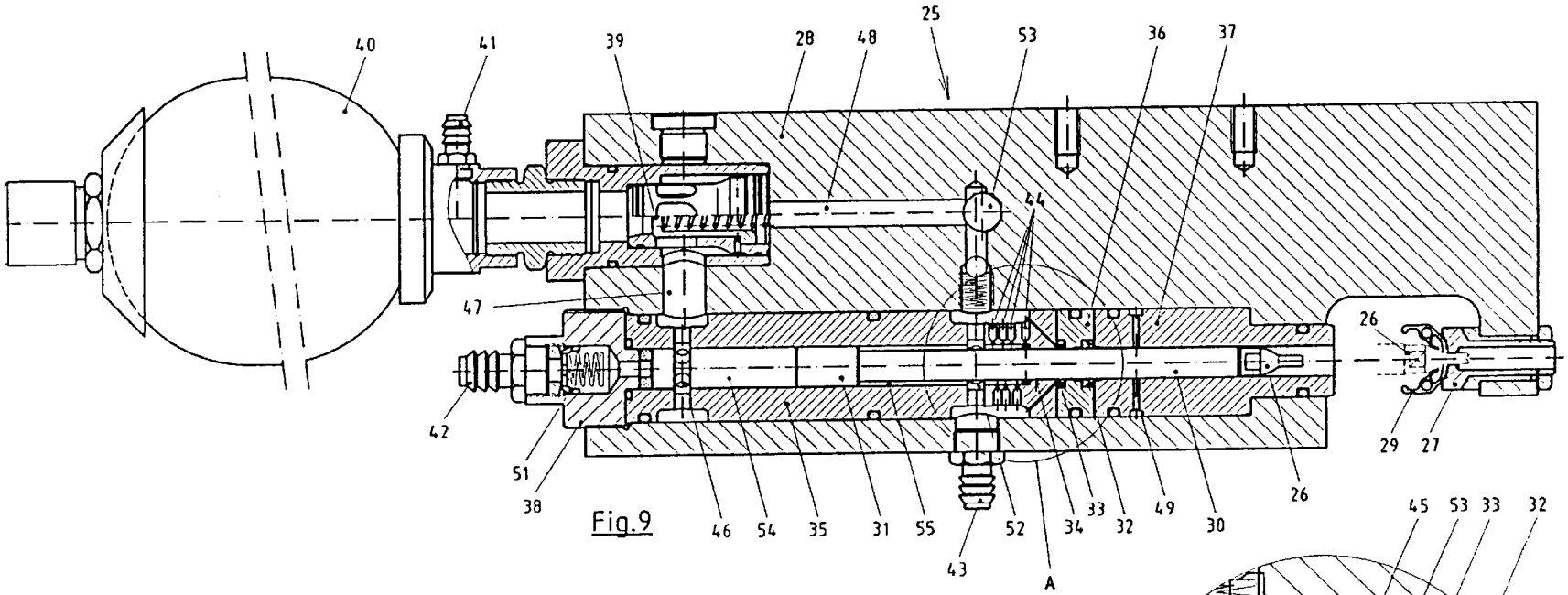
FIG. 9 shows a schematic cross-section of a second example of an embodiment of a punching apparatus according to the invention.

FIG. 9 shows a punching apparatus 25 for making a hole into a double-walled wheel rim 29 by means of punching. During punching the wheel rim 29 rests on a lower die 27, which is fixed in a house 28. A punch nipple 26 is attached to a piston rod 30 which together with a piston head 31 forms a plunger moving in a cylinder 35. The cylinder 35 is mounted in the house 28.

The piston rod 30 is sealed by means of a passage seal 34 in the cylinder 35 and passes through a ring 36 and a bush 37. The ring 36 incorporates a seal 33 and a scraper ring 32. The bush 37 is provided with a bore 49 connected to an air source (not shown) supplying air containing lubrication oil. The bore 49 is also connected to a pressure sensor, (not shown), which serves to detect whether the piston rod 30 still seals the opening of the bore 49 or whether the plunger is completely retracted, ready to carry out the next punch stroke.

The cylinder 35, the ring 36 and the bush 37 are fixed in the house 28 by means of a screw top 38. Furthermore, a valve 39 is mounted in the house 28 for cutting off the oil flow between an accumulator 40 and a duct 47. This valve 39 is operated by means of a duct 48 which, via a duct 53, is in contact with a control valve. Via a non-return-valve 50 the duct 53 is also connected with a pipe connection 43. A chamber 54, formed by the cylinder 35, the piston head 31 and the screw top 38, is connected with a pipe connection 42 via a perforated non-return-valve 51. The accumulator 40 can be filled via a pipe connection 41.

In the situation where the plunger is ready to carry out a punch stroke, that is to say when the piston head 31 in FIG. 9 is positioned at the very left, the piston head 31 closes off the ducts 46 which are provided in the wall of the cylinder 35. These ducts form the connection between chamber 54 and duct 47, which connection is opened after the plunger has carried out a fraction of its stroke.

Figure 11:
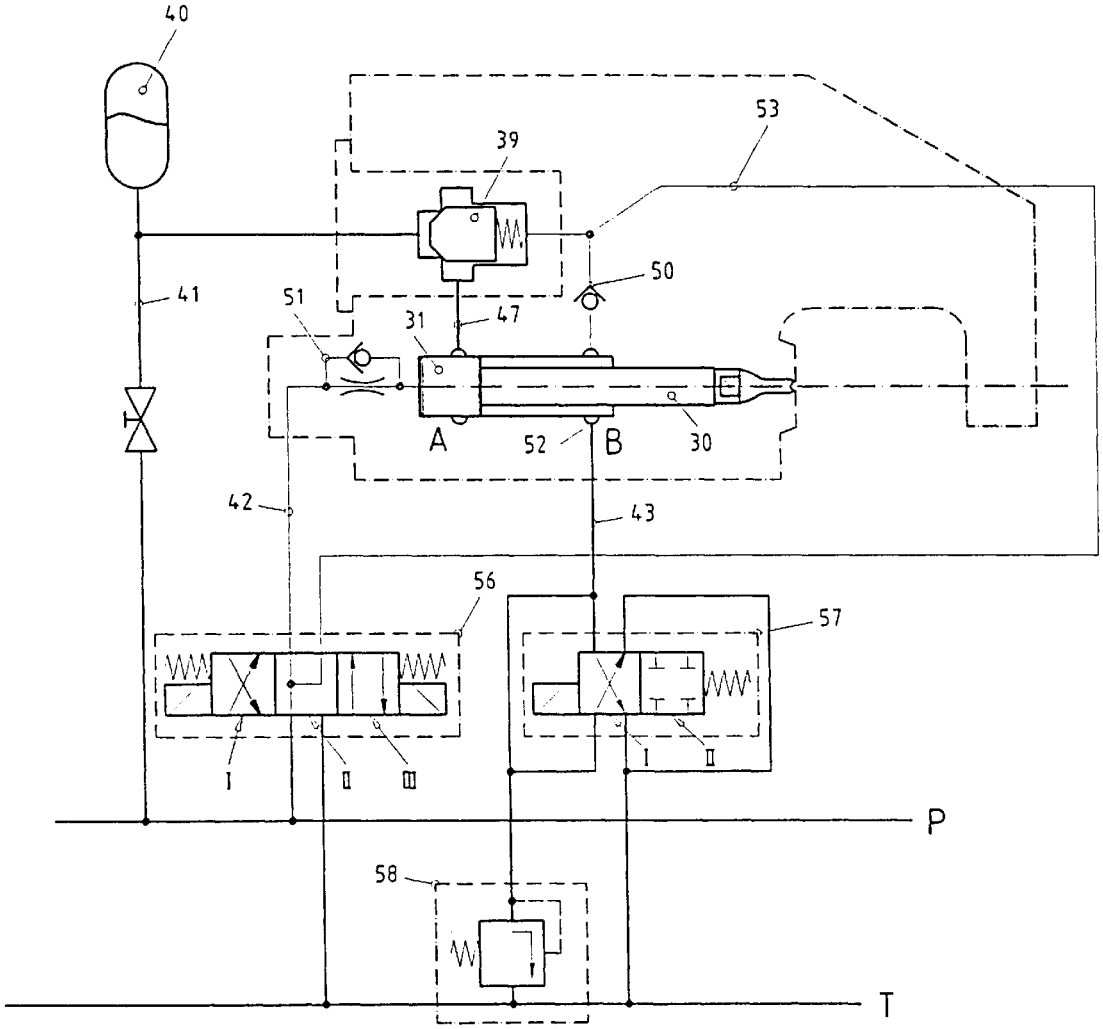
FIG. 11 shows the hydraulic system that is part of the punching apparatus according to FIG. 9.

During the stroke the oil present in the chamber 55 flows via the ducts 52 to the pipe connection 43 and from there to the drain pipe T (see FIG. 11). Just before the end of the punch stroke and thus just before the plunger in FIG. 9 is moved completely to the right, the ducts 52 are covered by the piston head 31, and the chamber 55 is connected with the pipe connection 43 exclusively via openings 44. Due to the openings 44 being very small, the oil pressure in the chamber 55 becomes very high while the plunger is slowed down evenly.

Figure 10:
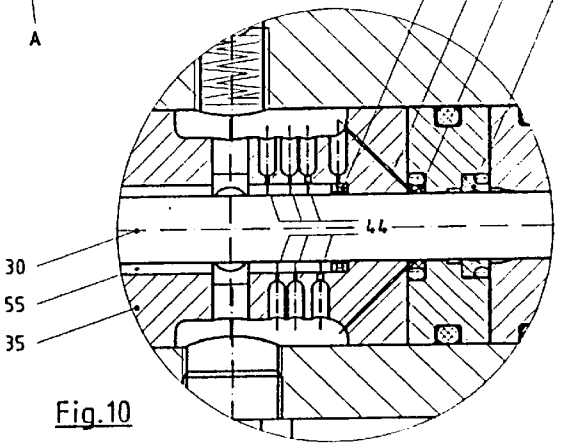
FIG. 10 shows detail A of FIG. 9.

FIG. 10 shows detail A illustrating the area where the plunger reaches its most extreme position. In this position the piston head 31 is arrested against a buffer ring 45. The oil seal between the piston rod 30 and the cylinder 35 has to comply with particular requirements, seeing as the piston rod 30 can move at high velocity, for instance 30 m/sec, while, at the end of the stroke the pressure in the chamber 55 may rise to more than 1000 bar. This oil seal is formed by the passage seal 34 in combination with the seal 33. The oil which is collected in the space in front of the seal 33, can drain away via a duct 53. At the seal 33 a coating of oil of a few micron's thickness is left behind on the fast moving piston rod 30. This is removed from the piston rod 30 by means of a scrape ring 32, as otherwise, during the punching and stopping action of the piston rod 30 oil may be released, which would contribute to considerable fouling.

FIG. 11 shows the hydraulic diagram of the punch apparatus, whereby the punch apparatus having a feed pipe P and a drain pipe T is connected with a pressure aggregate, not shown. The punch apparatus is operated by means of a control valve 56 and a washout valve 57 and a relieve valve 58. The relieve valve 58 serves as a safeguard for the washout valve 57, as otherwise inadmissibly high pressures could develop there.

The apparatus works as follows: the plunger is in position A. The control valve 56 is now in position I and the washout valve 57 in position II. The pressure prevailing in the accumulator 40 is P. Now the control valve 56 is turned to position III and the washout valve 57 to position I. This causes the valve 39 to open and duct 47 comes into direct contact with the accumulator 40. The pressure in duct 42 also becomes P, causing the plunger to move from A to B, while the velocity is limited by the extent of the oil flowing through the control valve 56. After the piston head 31 has passed the ducts 46 the oil flow increases strongly because it can flow unhindered from the accumulator 40 to the ducts 46. As a result the plunger accelerates to the stroke velocity of 30 m/sec. At the end of the stroke the plunger comes to a stop in the manner described above, the kinetic energy of the piston rod is absorbed by throttling from the oil flowing through the openings 44 (see FIG. 9 and 10).

The control valve 56 is now turned to position II causing for a short time an oil flow along the ducts 52, so that the oil warmed up by the throttling is drained away. Then the washout valve 57 is turned to position II and valve 39 closes.

By turning the control valve 56 to position I, the plunger will move to position A with a velocity limited by the perforated non-return valve 51.

In the embodiment described above, the arrest of the moving plunger possessing a hydraulic buffer is integrated with its hydraulic drive. Within the scope of the invention other embodiments are also conceivable, in which the buffering and the drive are separate. It is always important that the plunger is slowed down and brought to a stop over a short distance, preferably over 10 to 20 mm. The kinetic energy in the plunger has to be absorbed for the largest part and must not be released, otherwise the plunger will spring back. Springing back will result in the punch apparatus passing through the wheel rim a second time, which could be detrimental for the form of the hole.

The invention is not limited to the drawing shown or to the embodiment described above, which, within the scope of the invention, may be varied in several ways.

I claim:

1. An apparatus for punching holes in a double-walled hollow wheel rim comprising:

a punching die for locally supporting an inside wall of the wheel rim around the hole to be made, a punching tool with a cutting edge which is movable from a start position at a distance from the punching die to a stop position wherein the cutting edge is inside the punching die and drive means for the punching tool wherein the drive means can accelerate the punching tool to a speed of at least 10 m/sec between its start position and before the cutting edge touches an outside wall of a double-walled hollow wheel rim which is positioned with the inside wall against the punching die.

2. An apparatus according to claim 1, wherein braking means are provided to stop the punching tool moving at a speed of at least 10 m/sec over a distance shorter than 20 mm.

3. An apparatus according to claim 1, wherein braking means are provided to stop the punching tool moving at a speed of at least 10 m/sec by a hydraulic buffer suitable to absorb the punching tool's kinetic energy.

4. An apparatus according to claim 1, wherein the drive means are pneumatic.

5. An apparatus according to claim 1, wherein the punching tool possesses a concave point.

6. An apparatus according to claim 5, wherein the point of the punching tool is provided with a number of cutting teeth, evenly distributed over the circumference, being connected with each other from a point on the circumference by cutting edges.

7. An apparatus according to claim 6, wherein the punching tool has a cylindrically shaped part near the cutting edge and has a conical tapered part adjacent to the cylindrically shaped part.

8. An apparatus according to claim 1,wherein the drive means are provided with a stop which is adjustable in relation to the punching die.

9. A method for making aligned holes in both walls of a double-walled hollow wheel rim, the wheel rim comprising an inside wall and an outside wall, the method comprising the following steps:

positioning the inside wall of the wheel rim against a punching die, which mainly supports the wheel rim locally around the hole to be made, and punching with a cutting edge of a punching tool from the outside toward the center of the wheel rim in a continuous movement through both walls of the wheel rim and into the punching die.

10. A method according to claim 9 wherein the punching tool is accelerated to a speed of at least 10 m/sec before the cutting edge is moved through the outside wall of the wheel rim.

11. A method for making aligned holes in both walls of a double-walled hollow wheel rim, the wheel rim comprising an inside wall and an outside wall, the method comprising the following steps:

positioning the inside wall of the wheel rim against a punching die, which mainly supports the wheel rim locally around the hole to be made, punching with a cutting edge of a punching tool provided with an expansion part from the outside toward the center of the wheel rim in a continuous movement through both walls of the wheel rim and into the punching die, and stopping the movement of the punching tool before the expansion part reaches the inside wall.

12. A method according to claim 11 wherein the punching tool is accelerated to a speed of at least 10 m/sec before the cutting edge is moved through the outside wall of the wheel rim.

13. A method for making aligned holes in both walls of a double walled hollow wheel rim, the wheel rim comprising an inside wall and an outside wall, comprising the following steps:

positioning the inside wall of the wheel rim against a punching die, which mainly supports the wheel rim locally around the hole to be made, punching with the cutting edge of a punching tool provided with an expansion tool from the outside toward the center of the wheel rim in a continuous movement through both walls of the wheel rim and into the punching die, and stopping the movement of the punching tool before the expansion tool reaches the inside wall by absorbing the kinetic energy of the punching tool in a hydraulic buffer.

14. A method according to claim 13 wherein the punching tool is accelerated to a speed of at least 10 m/sec before the cutting edge is moved through the outside wall of the wheel rim.

15. A method for making aligned holes in both walls of a double-walled hollow wheel rim, the wheel rim having an inside wall and an outside wall, comprising the following steps:

positioning the inside wall of the wheel rim against a punching die, which mainly supports the wheel rim locally around the hole to be made, punching with the cutting edge of a punching tool provided with an expansion tool from the outside toward the center of the wheel rim in a continuous movement through both walls of the wheel rim and into the punching die, and stopping the movement of the punching tool before the expansion tool reaches the inside wall by absorbing the kinetic energy of the punching tool in a hydraulic buffer and removing the absorbed kinetic energy with the aid of a fluid.

16. A method according to claim 15 wherein the punching tool is accelerated to a speed of at least 10 m/sec before the cutting edge is moved through the outside wall of the wheel rim.

* * * * *